United States Patent [19]

Snow

[11] Patent Number: 4,737,273

[45] Date of Patent: Apr. 12, 1988

[54] FLOTATION PROCESS FOR RECOVERY OF PHOSPHATE VALUES FROM ORE

[75] Inventor: Robert E. Snow, Lakeland, Fla.

[73] Assignee: International Minerals & Chemical Corp., Terre Haute, Ind.

[21] Appl. No.: 815,964

[22] Filed: Jan. 3, 1986

[51] Int. Cl.[4] ..... B03D 1/06

[52] U.S. Cl. ..... 209/167; 209/166; 252/61

[58] Field of Search ..... 209/166, 167; 252/61

[56] References Cited

U.S. PATENT DOCUMENTS

| | | | |
|---|---|---|---|
| 2,168,849 | 8/1939 | Ralston et al. | 209/166 |
| 2,293,470 | 8/1942 | Mead et al. | 209/166 |
| 2,327,408 | 8/1943 | Ellis | 209/166 |
| 2,553,905 | 5/1951 | Evans | 209/12 |
| 2,904,177 | 9/1959 | Michal | 209/166 |
| 2,914,173 | 11/1959 | Le Baron | 209/166 |
| 2,967,615 | 1/1961 | Goin | 209/12 |
| 2,970,688 | 2/1961 | Uhland | 209/12 |
| 3,088,590 | 5/1963 | Haseman et al. | 209/12 |
| 3,099,620 | 7/1963 | Adam | 209/12 |
| 3,238,127 | 3/1966 | Sebba | 210/44 |
| 3,744,629 | 7/1973 | Baarson | 209/166 |
| 3,976,565 | 8/1976 | Petrovich | 209/166 |
| 4,006,014 | 2/1977 | Gannon | 75/2 |
| 4,098,686 | 7/1978 | Petrovich | 209/166 |
| 4,144,969 | 3/1979 | Snow | 209/166 |
| 4,225,428 | 9/1980 | Petrovich | 209/166 |
| 4,364,824 | 12/1982 | Snow | 209/167 |
| 4,377,472 | 3/1983 | Allen | 209/166 |
| 4,436,616 | 3/1984 | Dufour et al. | 209/3 |
| 4,440,636 | 4/1984 | Lilley | 209/10 |
| 4,472,270 | 9/1984 | Agrawal et al. | 209/166 |

OTHER PUBLICATIONS

Cooke, "The Flotation of Quartz Using Calcium Ion as Activator", *Mining Transactions*, vol. 184, pp. 306–309 (1949).

De Bruyn et al, "Particle Size and Flotation Rate of Quartz", *Mining Engineering*, pp. 415–419 (1956).

Product Data Sheet for ARQUAD ® Quaternary Ammonium Chlorides sold by Armak Company.

Product Data Sheet on Di-(Hydrogenated-Tallow-)-dimethyl-ammonium chloride, sold by Armak Company.

Product Information Sheet on PHILFLO TM, sold by the Mining Chemiclas Division of Phillips Petroleum Company.

Material Information Bulletin on CHEVRON Fuel Oil 6, sold by Chevron USA, Inc.

Material Safety Data Sheet on TERGITOL ®, sold by Union Carbide Corporation.

Material Safety Data Sheet on Hydrofluosilicic Acid, sold by General Electric Company.

*Primary Examiner*—S. Leon Bashore
*Assistant Examiner*—Andrew J. Anderson
*Attorney, Agent, or Firm*—Thomas L. Farquer; Wendell R. Guffey; Joseph M. Skerpon

[57] ABSTRACT

A process for recovering phosphate values from silica-containing phosphate ores is provided. The ore has a particle size in the range of about 0.6 to 1.2 mm and is subjected to selective flotation in the presence of a cationic flotation reagent comprising a di(hydrophobic group) quaternary ammonium salt, wherein each of the hydrophobic groups contain 6 or more carbon atoms and at least one of the groups contains from about 10–20 carbon atoms, in combination with a hydrocarbon oil and a phosphate depressing agent.

11 Claims, 2 Drawing Sheets

FLOTATION PROCESS FOR RECOVERY OF PHOSPHATE VALUES FROM ORE

BACKGROUND OF THE INVENTION

1. Field of the Invention

The present invention relates to the recovery of phosphate values from phosphate rock. More specifically, the present invention relates to a reagent and method for its use in flotation processes for beneficiating phosphate values from phosphate ores.

2. Description of the Prior Art

In the past, ores have been ground before froth flotation treatment in order to liberate one or more mineral species from a second mineral species in order to selectively float one species from the other. In addition, grinding of the minerals created new surfaces which were more responsive to flotation treatment. However, in the flotation of Florida phosphate ore, grinding of the mined ore has not generally been used.

In the processing of phosphate ore (also called the "matrix"), the ore is pumped from the fields in the form of a slurry and is first fed to a washing apparatus. In the washer, the slurry is pumped over a series of screens interspersed with log washers which act to break up clay balls and other large pieces in the matrix. Usually, there are three separate streams exiting the washer as shown in the flow diagram of the prior art process illustrated in FIG. 1. One is a phosphate pebble product stream typically having a BPL of about 65% and a particle size within the range of about 1 millimeter to about ¾ inch (+16 mesh). A second stream containing both phosphate values and insoluble siliceous minerals or gangue (i.e., sand) has an intermediate particle size range between about 0.1 and 1 millimeter (−16 mesh to +150 mesh). The third stream comprises clay slimes having a particle size below about 0.1 millimeter (−150 mesh). The slimes are typically discarded into a slime pond where the clay eventually settles. Of these three product streams, only the second is subjected to further processing.

In a conventional operation, the second stream is fed to a sizing apparatus which typically divides the phosphate and siliceous mineral containing fraction into three distinct particle size ranges. The finest of these three streams has a particle size range of about 0.1–0.4 millimeters (−35 mesh to +150 mesh). This stream is subjected to a fine flotation step using for example well-known anionic conditioning reagents wherein fine rough siliceous tailings are removed (and wasted) and a fine rough phosphate concentrate is collected in the froth.

The intermediate particle size stream coming from the sizing apparatus has a particle size range of about 0.4–0.7 millimeters (−24 mesh to +35 mesh) and is fed to a coarse flotation unit which also uses conventional anionic conditioning reagents. In the coarse rough flotation a coarse rough tailing is removed and may be wasted (or recycled after further sizing) and a coarse rough phosphate concentrate is collected in the froth and can be combined with the fine rough concentrate mentioned earlier.

The combined streams of the fine rough concentrate and the coarse rough concentrate then generally are sent to an acid (typically $H_2SO_4$) scrubbing unit to remove the fatty acid and fuel oil reagents. The acid scrubbed slurry then is washed with water and sent to a cationic (amine) flotation unit. Before flotation, the feed slurry is conditioned with a flotation reagent typically comprising a mixture of an amine and kerosene. The particle size of the material going into the amine flotation unit is very fine, with 82–90% being less than about 0.4 millimeters (−35 mesh). It is well known that amine flotation of quartz from phosphate is ineffective with coarser particle sizes (i.e., +35 mesh). See Cooke (1949), *Mining Transactions,* 184:306–309 and de Bruyn et al (1956), *Mining Engineering,* April, pp. 415–419. In the amine flotation, siliceous mineral impurities are removed in the froth and a phosphate concentrate, typically having a BPL value in the range of about 71–72% is collected in the cell underflow as product.

The third stream exiting from the sizing apparatus comprises particles having a very coarse particle size in the range of about 0.7–1.0 millimeters (−16 mesh to +24 mesh). The stream is beneficiated by a combination of chemical conditioning and mechanical separation techniques using a skin flotation device such as a spiral separator, a belt separator, a concentrating table or the like. As noted above, the conventional "double float" process using sequential anionic and cationic conditioning steps cannot be used to beneficiate this fraction because the cationic reagents are not effective for floating siliceous impurities of such large particle sizes. Thus, to beneficiate this fraction the art are relied on mechanical techniques to enhance the separation obtained using anionic reagents.

Normally this stream is chemically conditioned at a high solids concentration with a conventional anionic conditioning reagent such as a mixture of a fatty acid reagent, such as tall oil, and a fuel oil extender. The conditioning reagent may also include ammonia or caustic for pH control. The stream then is fed to the skin flotation device.

Probably the best skin flotation device is a spiral separation unit such as available from Jensco, Inc., Eaton Park, Fla. These devices comprise a series of downwardly sloping spiral troughs having a number of side exit ports in the trough along the inner edge thereof. The heavier siliceous materials tend toward the inside of the spiral trough while the lighter reagentized phosphate materials tend toward the outside. The inside exit ports are positioned to accomplish separation of the heavier siliceous materials. The spiral tails containing the siliceous minerals are then sent to a scavenger flotation cell wherein residual phosphate values are foamed to the top, while the heavier siliceous minerals are wasted from the bottom of the cell.

The spiral concentrate streams and the scavenger flotation cell streams generally then are combined to produce another stream typically having a BPL value of about 68% and an insoluble fraction of about 8–12%.

The spiral units and the other skin flotation devices used to separate siliceous mineral gangue from phosphate values in the very coarse (greater than about 0.7 millimeters (+24 mesh)) particle size range generally are troublesome pieces of equipment. Such devices have limited capacity per unit area. In the case of the spiral separator, rather small streams must be used in the spiral troughs and hence, for reasonable production numerous spiral units must be used. Since the streams are typically dirty, the units quickly become fouled and must frequently be shut down for cleaning.

In addition, while such equipment is almost universally used for separating siliceous minerals from phosphate values in the coarse particle size ranges, these devices are recognized to be inefficient separators. Thus, there has been a long felt need in the art to replace such skin flotation apparatus with equipment of much simpler, smaller and trouble-free design and operation. While flotation cells comprise a logical piece of equipment to replace the skin flotation apparatus, as noted above conventional flotation techniques have not been effective for floating the coarser size siliceous materials. For instance, the use of only a flotation cell without the prior use of a spiral unit would result in the loss of significant phosphate values.

U.S. Pat. No. 2,904,177 to Michal discloses a process for removing silicates, by flotation, from ilmenite ore ($FeTiO_3$) in order to recover titanium values. The disclosed process comprises grinding the ore to less than 60 mesh (−60 mesh) particle size and preparing an aqueous pulp therewith. Hydrofluoric acid is added as a regulator to acidify the pulp to a pH in the range of 3.0–6.0. Starch is added to depress the titanium. A cationic amine flotation agent, such as a quaternary ammonium salt of the higher aliphatic series, is added. Optionally, a frothing agent, such as pine oil, also may be added. The mixture then is subjected to froth flotation whereby siliceous impurities are separated by flotation from the titanium values.

U.S. Pat. No. 2,970,688 to Uhland discloses a typical two-step flotation process. The phosphate ore is first ground, sized, deslimed, and placed in an aqueous pulp. An anionic flotation agent having the ability to carry phosphate and heavy mineral values to the froth is added to the less than 35 mesh particle size fraction of the ore. The froth is recovered, washed and then reagentized with a cationic flotation agent having the ability to carry silica and heavy mineral values to the froth. The reagentized material then is subjected to a second flotation step. The cationic flotation agents disclosed include high molecular weight aliphatic quaternary ammonium bases and their water soluble salts.

U.S. Pat. No. 2,914,173 to LeBaron discloses a similar two-step flotation process for beneficiating the less than 35 mesh particle size fraction of a phosphate ore. In the second flotation step, a cationic flotation agent again is used. High molecular weight aliphatic quaternary ammonium bases and their water soluble salts are disclosed as possible flotation agents. There also is disclosed the addition of a cationic flotation agent in combination with kerosene.

As evident, the use of quaternary ammonium compounds for floating siliceous mineral impurities from a desired ore is known. As is the case with cationic collectors generally, however, the prior art has limited their use to flotation of small sized particles.

SUMMARY OF THE INVENTION

Thus, it is an important object of the present invention to provide a flotation method effective in selectively frothing and separating siliceous gangue from phosphate values in the coarser (i.e., greater than 0.6 millimeters, i.e., +28 mesh) particle size range.

It is another important object of the present invention to provide a flotation reagent effective to carry out such a flotation step.

It is a further important object of the present invention to provide an apparatus and process for replacing the skin flotation devices currently used in phosphate rock beneficiation plants.

The aforementioned objects, as well as many others, will become apparent to those skilled in the art from the description appearing hereinafter. These objects are met by a flotation process for recovering phosphate values from siliceous gangue-containing phosphate ores having a particle size greater than about 0.6 millimeters (i.e., greater than about +28 Tyler mesh). The ore is conditioned at a high solids concentration with a cationic flotation reagent comprising a particular type of a quaternary ammonium salt in combination with a hydrocarbon oil and a phosphate depressing agent and then is subjected to selective froth flotation.

Figure 1:
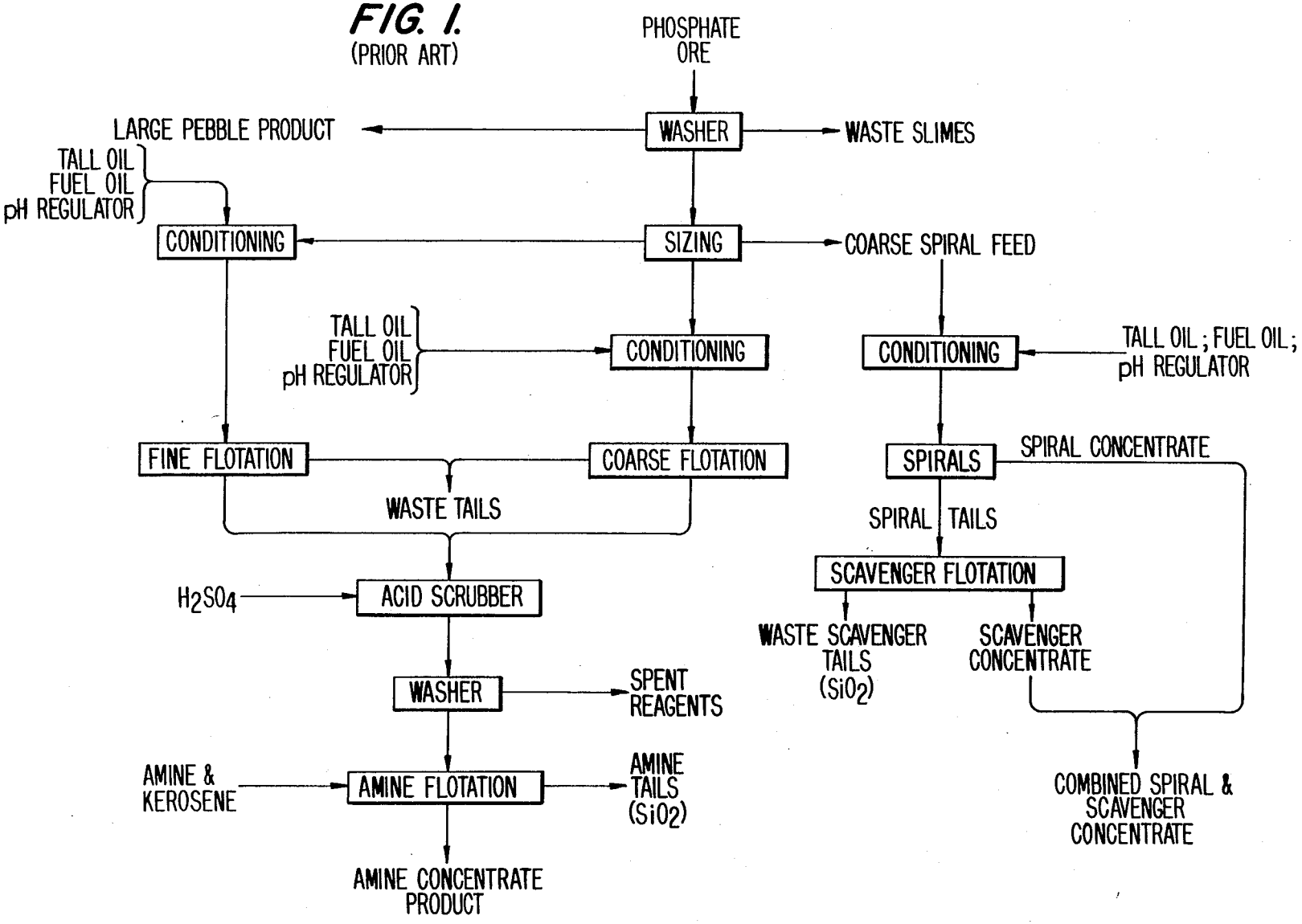
FIG. 1. (PRIOR ART)
FIG. 1 is a schematic flow diagram showing a typical prior art beneficiation process.
Figure 2:
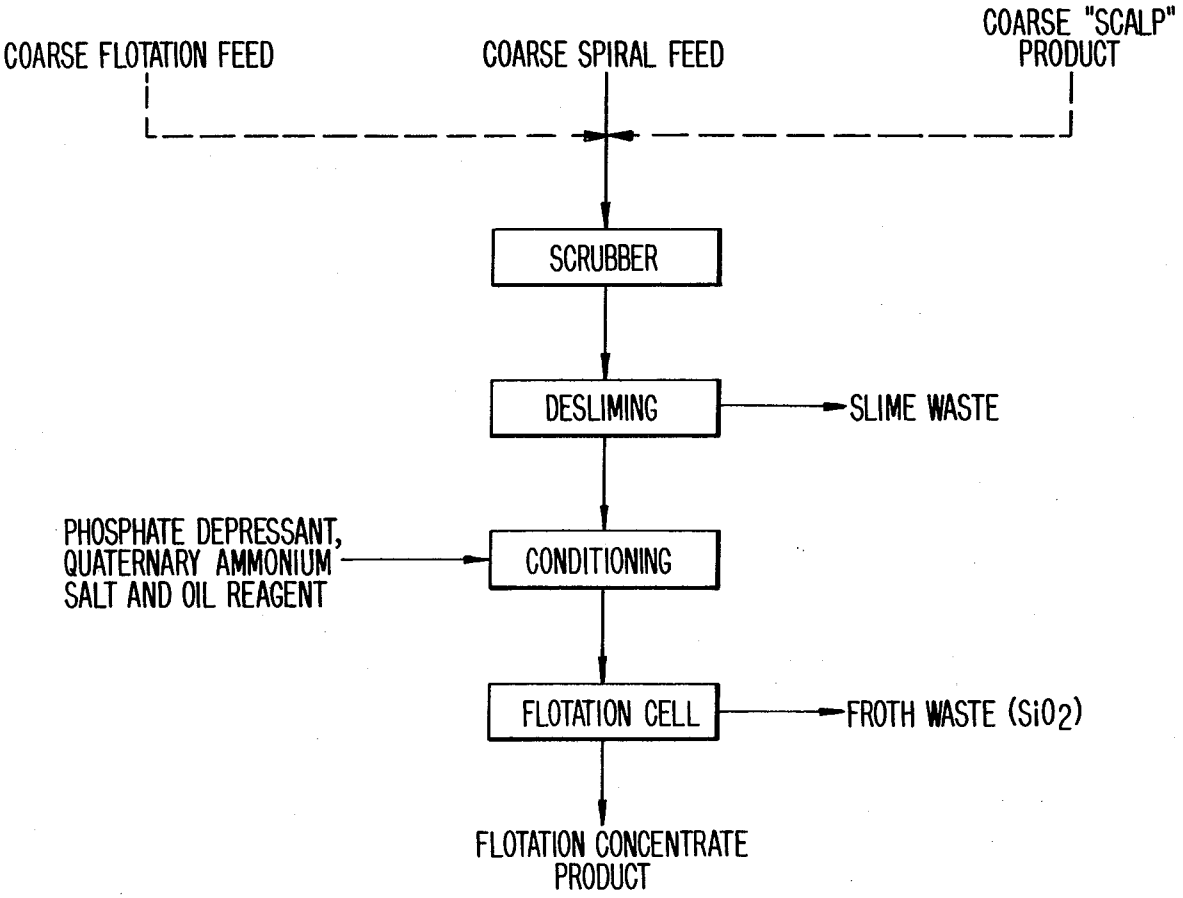
FIG. 2 is a schematic flow diagram illustrating one embodiment of the present invention.

Although certain embodiments of the present invention have been selected for illustration in the drawings and have been described in more detail hereinafter, it will be understood that these examples are merely representative of the present invention whose scope is defined in the appended claims.

As used herein, the term "mesh" refers to standard Tyler mesh, and if an ore fraction is said to have a particle size smaller than a certain mesh (−), such statement means that substantially all of the fraction will pass through a screen having that Tyler mesh size, and likewise, if an ore fraction is said to have a particle size greater than a certain mesh (+), then substantially none of the material will pass through a screen having that Tyler mesh size.

DETAILED DESCRIPTION OF THE INVENTION

The present invention is directed to a process for conditioning, for subsequent selective froth flotation, a phosphate rock slurry containing siliceous impurities having a particle size of about +28 mesh wherein flotation causes the siliceous impurities to be concentrated in the froth and wherein phosphate rock having a reduced concentration of siliceous impurities is removed from the flotation underflow as the tails product. In carrying out the process, a pre-scrubbed, coarsely sized phosphate ore, in the form of a slurry having about 50% or more solids, preferably 60 to 70%, is fed to a conditioning vessel. The phosphate rock slurry is conditioned with a cationic reagent comprising a specific type of quaternary ammonium salt, a hydrocarbon oil and a phosphate depressing agent.

The quaternary ammonium salts used in the flotation reagent of the present invention include compounds which form quaternary ammonium ions having two hydrophobic hydrocarbon groups each having 6 or more carbon atoms and at least one of which contains from about 10–20 carbon atoms, preferably 12–18 carbon atoms. The quaternary ammonium ions preferably have two long chain, hydrophobic, aliphatic hydrocarbon groups containing from 10–20 carbon atoms, preferably 12–18 carbons atoms. The remaining sites on the quaternary ammonium may be occupied by any number of hydrocarbon species as long as they do not interfere with the hydrophobic action of the long chain hydrocarbon group. Quaternary ammonium ions wherein the remaining sites are occupied by lower alkyl groups such as methyl, ethyl and the like have been found to be particularly useful.

Quaternary ammonium salts in which one of the hydrophobic groups on the quaternary ammonium ion comprises an aralkyl or an alkyl aryl hydrocarbon radical having from 6–20 carbon atoms, preferably 7–18 carbon atoms such as phenyl, benzyl, tolyl, phenethyl and the like, also can be used in the present invention. As will be shown in the following specific examples, tri lower-alkyl quaternary ammonium salts having only a single hydrophobic hydrocarbon group do not provide the type of performance exhibited by the above described quaternary ammonium compounds.

Examples of specific quaternary ammonium salts which have been found useful in the flotation reagents of the present invention include di lower-alkyl di(hydrogenated-tallow) ammonium chlorides having the general formula:

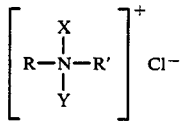

wherein R and R′ represent hydrogenated tallows containing from about 10–20, preferably 12–18, carbon atoms and X and Y are both lower alkyl groups having 1 to 3 carbon atoms which may be the same or different; lower-alkyl benzyl di(hydrogenated-tallow) ammonium chloride having the formula:

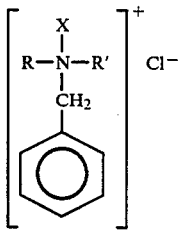

wherein R and R′ represent hydrogenated tallows containing about 10–20 carbon atoms and X is a lower alkyl group having 1–3 carbon atoms; and di lower-alkyl benzyl hydrogenated-tallow ammonium chlorides having the formula:

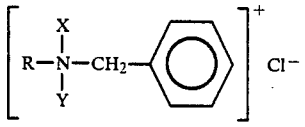

wherein R represents a hydrogenated tallow having about 10–20 carbon atoms and X and Y are lower alkyl groups having 1 to 3 carbon atoms which may be the same or different.

Suitable quaternary ammonium salts useful in the present invention include dimethyl di(hydrogenated-tallow) ammonium chloride, a quaternary ammonium salt having the formula $R_1R_2N(CH_3)_2Cl$, with a molecular weight of about 565, a boiling point of about 80° C., a freezing point of about 95° F.; dimethyl dicoco ammonium chloride and dimethyl benzyl tallow ammonium chloride. A formulation of the preferred dimethyl di(-hydrogenated-tallow) ammonium chloride quaternary ammonium salt in aqueous isopropanol which can be used in the present invention is sold under the trade name Arquad 2HT-75 by Armak Industrial Chemicals Division.

The quaternary ammonium salt is added to the phosphate rock slurry in an amount sufficient to reagentize the siliceous impurities. A level between about 0.2 to 2.2 lbs. of active quaternary ammonium salt per dry ton of ore has proven to be suitable. The optimum quantity for a particular feed fraction can be determined by routine experimentation. If too low a level is used the phosphate concentrate recovered from the underflow of the flotation separation still contains a significant quantity of siliceous impurity, while higher addition levels normally are not justified economically.

The quantity of quaternary ammonium salt needed to provide the desired degree of selectivity is strongly influenced by the make-up of the phosphate rock slurry. If the slurry contains slime-forming constitutents such as clay, mud chips, chalk rock and the like, reagent consumption will be increased and performance may become erratic. Since the majority of phosphate rock reserves unavoidably contain such slime-forming constituents, it is important to the successful practice of the present invention that the coarse phosphate rock slurry feed fraction be pre-treated to remove such contaminants before conditioning with the quaternary ammonium salt reagent. As a result, it is an important aspect of the present invention that the phosphate rock slurry receive a pre-conditioning attrition scrub. A phosphate rock slurry having a low amount of slime-forming constituents either naturally or as a result of attrition scrubbing is referred to as a "low slime" phosphate rock slurry.

Attrition scrubbing involves subjecting the rock slurry to moderate mechanical action or shaking, as for example can be accomplished by mixing or stirring the slurry using conventional mixing equipment such as flat bladed impellers and the like. A level of agitation is required sufficient only to free friable material such as clay from the ore particles without breaking the particles. Those skilled in the art will recognize other suitable equipment and operating conditions. Thus, attrition is not grinding, pulverization or even a rough fragmentation where particles are broken into smaller pieces. In fact, as is apparent to those skilled in the art, the particle size distribution of the major portion of the scrubbed slurry (i.e., neglecting the slimes) is only slightly affected by this procedure.

After the slurry has been attrition scrubbed, the slimes are removed and the slurry is conditioned. The slimes can be removed by diluting the high solids slurry with water and passing the diluted slurry through a cyclone separator. The separated slime fraction removed from the cyclone is wasted while the underflow containing the deslimed slurry is dewatered to raise its solids concentration to greater than 50%, and preferably between 60 to 70%, for example by passing it over dewatering screens. The high solids slurry then is fed into the conditioning vessel.

In addition to the quaternary ammonium salt, a hydrocarbon oil also is added to the phosphate rock slurry in the conditioning vessel. The hydrocarbon oil enhances the effectiveness of the quaternary ammonium salt. Generally, the hydrocarbon oil is employed at a weight to weight ratio of hydrocarbon oil to quaternary ammonium salt of from about 2:1 to about 4:1, preferably at a ratio of about 3:1. Preferably, a heavy hydrocarbon oil is used. As examples of the heavy hydrocarbon oil utilized in the flotation reagents of the present invention, there can be mentioned Philflo oil, a non-polar collector sold by Phillips Mining Chemicals, a subsidiary of Phillips Petroleum Company, having a density of 60° F. of 8.5 lbs/gal, a flash point of 210° F., a pour point of 45° F. and a kinematic viscosity at 70° F. of 37 cs; ORFOM TM 50, a sulfur-based collector reagent sold by Phillips Chemical Company, a subsidiary of Phillips Petroleum Company; El Paso No. 4 oil sold by Standard Oil of California; Chevron Fuel Oil No. 6, a mixture of petroleum residua (atmospheric or vacuum) and cutter stocks (light cycle oils, diesel or jet) blended to meet specifications; Belcher #5 Oil sold by Belcher Oil Co., jojoba oil (a vegetable oil), and indene.

Many other types of hydrocarbon oils may also be used in the practice of the present invention and the suitability of a particular oil can be determined by routine experimentation. However, it has been determined that certain types of oil often used with cationic amine reagents, specifically while mineral oil, kerosene and International Petroleum Company reclaimed oil, tend to yield inferior results when used in the method of the present invention and thus are less preferred.

The final component of the conditioning reagent mixture is a phosphate depressing agent. The preferred phosphate depressing agent is fluosilicic acid is added in an amount to lower the pH of the high solids phosphate rock slurry to within the range of about 3 to 4.5, preferably 3.8 to 4.2. While other known phosphate depressing agents active in depressing phosphate values in a phosphate rock slurry containing predominantly siliceous gangue, such as sulfuric acid, PhosSaver (a gelatinized starch), orthophosphoric acid, sodium tripolyphosphate, sodium hexametaphosphate, sodium pyrophosphate and the like, could be used, fluosilicic acid is much more economical, permits easier control of the flotation operation and does not contribute to severe water contamination problems. Thus, fluosilicic acid is highly preferred.

The conditioning of the phosphate rock slurry may be carried out in any suitable equipment, e.g. an agitated vessel, as is well known in the art. The conditioning time and temperature are also the same as employed in conventional conditioning procedures, for example, conditioning times generally range from about 0.25 to about 4 minutes.

The conditioned high solids phosphate rock slurry is then diluted with water to lower its solids concentration to within the range of about 20 and 30% and is subjected to froth flotation in a flotation cell using standard flotation equipment and procedures known in the art. The flotation is effective to remove, in the froth overflow, a substantial amount of the siliceous impurity of the phosphate rock slurry. The underflow contains the phosphate product. The diluted food generally has a pH in the range of about 4.8–6.8.

The following examples illustrate the exceptional recovery of phosphate values from the coarse particle size fraction of phosphate and siliceous gangue containing streams that can be obtained using the flotation reagents of the present invention.

EXAMPLES 1-15

Sample ore having about 69% by weight of particles +28 mesh, an average BPL value of about 53% and an average insoluble fraction of about 29% was fed to attrition scrubbers (three 10" diameter in series) by a screw feeder at a feed rate of 600 lbs/hr. The total scrubber retention time was approximately 3–4 minutes and its percent solids was 50–55%. The scrubbed feed was deslimed with a 6"×6" hydraulic sizer operated at 3 gpm teeter water rate and 1.05 bed density. The hydrosizer overflow solids (waste) accounted for 3–6% by weight of the feed. Approximately 25–35% of the overflow solids was +200 mesh material. The hydrosizer underflow was diluted from 60% solids to about 20% solids for pumping.

A stationary screen with 0.15 mm opening sieve (100 Tyler mesh) was used to densify the slurry to 60% solids before entering a 10" diameter conditioner. The conditioning time was about 15 seconds or less. A dimethyl di(hydrogenated-tallow) ammonium chloride salt sold by Armak Industries, a division of Akzona, Inc., under the trademark ARQUAD® 2HT-75 and Philflo oil were added at this point. Fluosilicic acid (3% solution) was used as the pH regulator.

The conditioned feed was fed into a bank of four flotation cells. Tergitol NP-10 frother, a nonylphenol polyethylene glycol ether sold by Union Carbide Corporation ($C_{36}H_{66}O_{10}$), was added to each cell at the starvation rate. The cell overflow was coarse silica, the underflow product being coarse phosphate concentrate.

A series of test runs were conducted at varying reagent levels and pH levels. The test results are summarized in Table 1.

TABLE 1

| Example No. | Dimethyl di(hydrogenated-tallow) Ammonium Chloride lbs/Ton | Philflo Oil lbs/Ton | pH | Concentrate: Bone Phosphate of Lime (BPL) | Concentrate: Insolubles % | Concentrate: Flotation[1] Recovery |
|---|---|---|---|---|---|---|
| 1 | 1.0 | 4.0 | 4.1 | 71.60 | 5.93 | 95.1 |
| 2 | 0.8 | 3.2 | 4.0 | 71.74 | 5.52 | 94.6 |
| 3 | 1.0 | 4.0 | 4.0 | 73.20 | 5.22 | 97.2 |
| 4 | 1.2 | 4.8 | 4.0 | 73.62 | 4.38 | 94.8 |
| 5 | 1.2 | 4.8 | 3.5 | 71.57 | 5.23 | 97.2 |
| 6 | 0.8 | 3.2 | 5.2 | 57.40 | 24.38 | 99.6 |
| 7 | 0.8 | 3.2 | 4.5 | 59.75 | 19.88 | 99.1 |
| 8 | 0.8 | 3.2 | 4.1 | 69.36 | 7.35 | 97.8 |
| 9 | 1.0 | 4.0 | 5.0 | 69.65 | 8.66 | 80.7 |
| 10 | 1.0 | 4.0 | 4.5 | 68.87 | 7.41 | 85.1 |
| 11 | 0.6 | 2.4 | 4.5 | 69.15 | 9.03 | 98.3 |
| 12 | 0.8 | 3.2 | 3.6 | 69.57 | 7.86 | 98.1 |
| 13 | 1.0 | 4.0 | 3.6 | 70.39 | 6.42 | 95.1 |
| 14 | 0.6 | 2.4 | 4.0 | 69.15 | 8.09 | 98.4 |
| 15 | 1.2 | 4.8 | 4.5 | 70.80 | 5.70 | 89.8 |

[1]Based on Floation feed.

From the data in Table 1, it was determined that there was insufficient fluosilicic acid in test runs Nos. 6 and 7. The pH values for these two test runs were 5.2 and 4.5, respectively. Thus, in using fluosilicic acid as a selectivity enhancer, it is preferable that the pH be within the range of 3–4.5. The preferred pH range will vary depending upon the particular type of selectivity enhancer used and the level of conditioning reagent.

EXAMPLES 16–24

A set of experiments was conducted comparing the effectiveness of dimethyl di(hydrogenated-tallow) ammonium chloride (2HT-75) with a conventional cationic amine reagent (acetate salt of tall oil and diethylenetriamine condensation product—IMC 3010). Slurries of various samples, having approximately 40% by weight of particles +28 mesh, a BPL value of about 31% and about a 55% insoluble fraction, were conditioned for 30 seconds at a 65% solids concentration with varying reagent levels. Philflo oil at an oil to cationic reagent weight ratio of 3:1 was used. Tegitol NP-10 (about 0.13 lb per ton of feed) also was added as a froth stabilizer. The samples of the conditioned slurry were diluted and then subjected to froth flotation in a 500 g laboratory Denver flotation cell at about 18% solids concentration. The results are presented in Table 2.

TABLE 2

| Example No. | CATIONIC COLLECTOR TYPE | Amount lbs/Ton | pH | BPL (%) | INSOLUBLES (%) | Recovery (%) |
|---|---|---|---|---|---|---|
| 16 | IMC 3010 | 0.4 | 7.1 | 38.02 | 45.9 | 98.5 |
| 17 | IMC 3010 | 0.6 | 7.1 | 50.60 | 29.31 | 98.3 |
| 18 | IMC 3010 | 0.8 | 7.0 | 67.01 | 8.18 | 96.1 |
| 19 | IMC 3010 | 1.0 | 7.1 | 68.25 | 7.26 | 95.1 |
| 20 | 2HT-75 | 0.4 | 7.1 | 69.89 | 5.85 | 95.0 |
| 21 | 2HT-75 | 0.6 | 7.1 | 71.05 | 2.57 | 79.4 |
| 22 | 2HT-75 | 0.8 | 7.0 | 71.36 | 2.91 | 58.0 |
| 23[2] | 2HT-75 | 0.8 | 7.3 | 72.29 | 2.72 | 93.9 |
| 24[3] | 2HT-75 | 0.8 | 7.2 | 71.73 | 2.62 | 84.7 |

[2]0.5 lb/Ton of sodium tripolyphosphate added as phosphate depressing agent.
[3]0.5 lb/Ton of Phosaver, a gelatinized starch phosphate depressing agent added.

Only ore slurries conditioned with the quaternary ammonium salt of this invention produced an overflow concentrate having less than about a 5% insoluble fraction. Furthermore, to produce a concentrate having less than 10% insolubles required about 1.5 times as much amine reagent as the quaternary ammonium salt. As shown in Examples 23 and 24, the tendency of the quaternary ammonium salt to float phosphate, as well as siliceous impurities which reduces the overall recovery, can be offset by using a phosphate depressing agent.

EXAMPLES 25–42

A set of experiments were conducted on a variety of phosphate rock samples using dimethyl di(hydrogenated tallow) ammonium chloride (2HT-75), Philflo Oil and fluosilicic acid as the conditioning reagent to illustrate the importance of attrition scrubbing prior to conditioning.

In all of the examples, the fluosilicic acid was added at a level of 0.45 lb/Ton and the phosphate rock slurries were conditioned at 65% solids concentration for 15 seconds using the quantity of quarternary ammonium salt and heavy hydrocarbon oil shown in Tables 4 and 6.

Table 3 presents the analysis (particle size and ore concentration) of the original phosphate rock samples. Table 4 presents the results of froth flotation experiments using these samples. As shown, only in a very small number of experiments did direct conditioning of the raw phosphate rock slurry and subsequent froth flotation produce a phosphate concentrate having less than about a 10% insoluble fraction.

TABLE 3

| Example No. | RAW PHOSPHATE ROCK FEED CHARACTERISTICS PARTICLE SIZE (%) +24 MESH | +35 MESH | BPL % | INSOLUBLES % |
|---|---|---|---|---|
| 25 | 52.2 | 83.4 | 57.23 | 23.85 |
| 26 | 57.6 | 89.4 | 58.24 | 21.01 |
| 27 | 39.5 | 75.3 | 41.60 | 42.91 |
| 28 | 72.8 | 96.7 | 64.77 | 12.39 |
| 29 | 66.1 | 93.0 | 60.68 | 18.39 |
| 30 | 74.4 | 96.4 | 63.20 | 13.77 |
| 31 | 74.3 | 97.6 | 58.33 | 19.11 |
| 32 | 78.5 | 99.1 | 64.39 | 12.85 |
| 33 | 73.9 | 97.0 | 67.15 | 11.26 |

TABLE 4

| Example No. | Dimethyl di(hydrogenated-tallow) Ammonium Chloride lbs/Ton | Philflo Oil lbs/Ton | pH | Concentrate Bone Phosphate of Lime (BPL) | Insolubles % | Flotation[4] Recovery |
|---|---|---|---|---|---|---|
| 25A | 1.2 | 3.6 | 4.0 | 70.29 | 7.82 | 88.6 |
| 25B | 1.5 | 4.5 | 4.1 | 68.36 | 9.06 | 85.3 |
| 26A | 1.8 | 5.4 | 5.2 | 60.31 | 18.22 | 98.4 |
| 26B | 2.4 | 5.4 | 5.0 | 60.75 | 18.02 | 97.9 |
| 27A | 1.2 | 3.6 | 4.7 | 56.65 | 23.74 | 88.8 |
| 27B | 1.5 | 4.5 | 4.7 | 59.48 | 19.28 | 81.6 |
| 28A | 1.8 | 5.4 | 4.5 | 65.72 | 11.28 | 98.1 |
| 28B | 2.4 | 5.4 | 4.6 | 65.04 | 12.32 | 97.6 |
| 29A | 1.2 | 3.6 | 4.1 | 70.61 | 4.64 | 77.4 |
| 29B | 1.0 | 3.0 | 4.0 | 70.20 | 5.88 | 86.9 |
| 30A | 1.8 | 5.4 | 4.4 | 63.73 | 12.08 | 99.5 |
| 30B | 2.4 | 5.4 | 4.6 | 64.13 | 12.64 | 99.3 |
| 31A | 1.8 | 5.4 | 4.5 | 59.14 | 18.36 | 98.6 |
| 31B | 2.4 | 5.4 | 4.5 | 59.72 | 17.32 | 98.4 |
| 32A | 1.8 | 5.4 | 4.3 | 68.49 | 8.19 | 84.2 |
| 32B | 2.4 | 5.4 | 4.1 | 65.45 | 11.57 | 95.2 |

TABLE 4-continued

| Example No. | Dimethyl di(hydrogenated-tallow) Ammonium Chloride lbs/Ton | Philflo Oil lbs/Ton | pH | Concentrate Bone Phosphate of Lime (BPL) | Insolubles % | Flotation[4] Recovery |
|---|---|---|---|---|---|---|
| 33A | 1.2 | 3.6 | 4.1 | 72.54 | 4.74 | 95.4 |
| 33B | 1.5 | 4.5 | 4.0 | 73.18 | 5.16 | 95.1 |

[4]Based on flotation feed.

Table 5 presents the analysis of the attrition scrubbed phosphate rock samples. The attrition scrubbed sample of Example 34 corresponds to raw rock of Example 25, the attrition scrubbed sample of Example 35 corresponds to the raw rock of Example 26 and so on. The raw phosphate rock samples were subjected to attrition scrubbing for 3 minutes and desliming at −200 mesh. As shown, less than 5% of each sample was removed by attrition scrubbing, with BPL recoveries after attrition scrubbing of generally above 96–97%. Table 6 presents the results of froth flotation experiments using the samples of Examples 34–42. In all but one case (Example 40A), a phosphate concentrate having less than 10% insoluble fraction was produced. In fact, in over half of the experiments the recovered phosphate concentrate had an insoluble fraction of less than about 5%.

TABLE 5

| Example No. | ATTRITION SCRUBBED PHOSPHATE ROCK CHARACTERISTICS BPL RECOVERY % | PARTICLE SIZE −200 MESH % | BPL % | INSOLUBLES % |
|---|---|---|---|---|
| 34 | 96.5 | 3.4 | 57.75 | 23.46 |
| 35 | 96.5 | 3.9 | 58.39 | 21.96 |
| 36 | 92.8 | 4.2 | 38.58 | 47.11 |
| 37 | 97.7 | 2.8 | 64.13 | 13.13 |

TABLE 5-continued

| Example No. | ATTRITION SCRUBBED PHOSPHATE ROCK CHARACTERISTICS BPL RECOVERY % | PARTICLE SIZE −200 MESH % | BPL % | INSOLUBLES % |
|---|---|---|---|---|
| 38 | 98.0 | 1.8 | 59.44 | 20.17 |
| 39 | 97.5 | 3.2 | 64.29 | 13.58 |
| 40 | 98.1 | 2.2 | 57.84 | 20.11 |
| 41 | 97.9 | 2.5 | 65.40 | 12.87 |
| 42 | 96.7 | 3.2 | 67.08 | 12.42 |

TABLE 6

| Example No. | ATTRITION SCRUBBED PHOSPHATE ROCK SLURRY Dimethyl di(hydrogenated-tallow) Ammonium Chloride lbs/Ton | Philflo Oil lbs/Ton | pH | Concentrate Bone Phosphate of Lime (BPL) | Insolubles % | Flotation[5] Recovery |
|---|---|---|---|---|---|---|
| 34A | 0.7 | 2.1 | 4.3 | 72.96 | 3.95 | 79.4 |
| 34B | 0.6 | 1.8 | 4.4 | 73.23 | 3.67 | 85.5 |
| 35A | 1.0 | 3.0 | 4.8 | 72.69 | 4.13 | 72.3 |
| 35B | 0.7 | 2.1 | 4.7 | 70.17 | 6.68 | 91.7 |
| 36A | 0.7 | 2.1 | 4.5 | 69.09 | 7.14 | 84.3 |
| 36B | 0.8 | 2.4 | 4.5 | 69.82 | 6.28 | 85.8 |
| 37A | 1.0 | 3.0 | 4.7 | 70.07 | 6.12 | 86.1 |
| 37B | 1.2 | 3.6 | 4.7 | 71.59 | 3.87 | 70.5 |
| 38A | 0.8 | 2.4 | 4.1 | 71.80 | 4.77 | 89.2 |
| 38B | 0.6 | 1.8 | 4.1 | 71.60 | 4.18 | 89.6 |
| 39A | 1.0 | 3.0 | 5.6 | 67.11 | 9.69 | 95.8 |
| 39B | 1.2 | 3.6 | 5.6 | 70.40 | 6.05 | 94.3 |
| 40A | 1.2 | 3.6 | 5.4 | 65.91 | 10.46 | 89.9 |
| 40B | 1.5 | 4.5 | 5.4 | 67.14 | 7.09 | 76.8 |
| 41A | 1.0 | 3.0 | — | 72.75 | 3.38 | 76.0 |
| 41B | 0.8 | 2.4 | 4.2 | 72.98 | 3.50 | 86.4 |
| 42A | 0.8 | 2.4 | 3.9 | 73.60 | 4.84 | 94.6 |
| 42B | 1.0 | 3.0 | 3.8 | 74.54 | 4.01 | 88.7 |

[5]Based on Attrition scrub feed.

EXAMPLES 43–49

These examples demonstrate the importance of using the claimed quaternary ammonium salts rather than other quaternary ammonium salts or cationic amine collectors. A phosphate rock slurry having 74.4% by weight of its particles +28 mesh, a BPL value of about 48.5% and about 31.7% insoluble fraction was conditioned with the variety of different reagents identified in Table 7, was diluted to 18% solids and was subjected to froth flotation. The samples were conditioned at a 68% solids concentration for 15 seconds. The cationic reagents used, the level of their use and the flotation results obtained are shown in Table 7.

TABLE 7

| Example No. | CATIONIC COLLECTOR TYPE | Amount[6] lbs/Ton | Concentrate BPL (%) | INSOLUBLES (%) | Flotation Recovery (%) |
|---|---|---|---|---|---|
| 43 | Dimethyl di(hydrogenated tallow) ammonium chloride (Arquad 2HT-75) | 0.36 | 67.11 | 5.64 | 97.9 |
| 44 | Dimethyl dicoco ammonium chloride (Arquad 2C-75) | 0.36 | 61.59 | 13.62 | 98.6 |
| 45 | Dimethyl benzyl tallow ammonium | 0.36 | 63.68 | 10.24 | 99.2 |

TABLE 7-continued

| Example No. | TYPE | Amount[6] lbs/Ton | Concentrate BPL (%) | Concentrate INSOLUBLES (%) | Concentrate Flotation Recovery (%) |
|---|---|---|---|---|---|
| | CATIONIC COLLECTOR | | | | |
| | chloride (Arquad HTB-75) | | | | |
| 46 | Trimethyl tallow ammonium chloride (Arquad T-50) | 0.36 | 54.69 | 22.55 | 99.7 |
| 47 | Trimethyl coco ammonium chloride (Arquad C-50) | 0.36 | 49.44 | 29.88 | 99.9 |
| 48 | Tall oil - diethylenetriamine condensate (acetate salt) (IMC 3010) | 0.48 | 56.30 | 21.03 | 99.7 |
| 49 | Primary Tallow amine (acetate salt) (Armac T)[7] | 0.48 | 48.86 | 31.15 | 99.5 |

[6]100% cationic reagent basis
[7]Available from Akzo Chemie America.

In addition to the cationic reagent, 1.44 lb/Ton of standard #6 fuel oil and 0.53 lb/ton of fluosilicic acid also were added for conditioning the rock slurry. As shown in Table 7, only the quaternary ammonium salts having two hydrophobic hydrocarbon groups each having 6 or more carbon atoms and at least one of which contains from about 10–20 carbon atoms were able to upgrade the BPL value of the phosphate rock and reduce the insoluble fraction to about 10% or less.

EXAMPLES 50–54

The procedure of Examples 43–49 was repeated using a phosphate rock slurry of 65% solids, having 74.9% by weight of its particles +28 mesh, a BPL value of about 62.8% and about a 17.4% insoluble fraction. Flotation results are presented in Table 8. As shown, only the quaternary ammonium salts of this invention were able to reduce the insolubles fraction of the phosphate rock slurry to less than 10%.

TABLE 8

| Example No. | TYPE | Amount[8] lbs/Ton | Concentrate (BPL) % | Concentrate INSOLUBLES (%) | Concentrate Flotation Recovery % |
|---|---|---|---|---|---|
| | CATIONIC COLLECTOR | | | | |
| 50 | Dimethyl di(hydrogenated tallow) ammonium chloride (Arquad 2HT-75) | 0.36 | 75.51 | 5.04 | 98.5 |
| 51 | Dimethyl dicoco ammonium chloride (Arquad 2C-75) | 0.36 | 72.31 | 5.36 | 98.5 |
| 52 | Dimethyl benzyl tallow ammonium chloride (Arquad HTB-75) | 0.36 | 71.42 | 6.12 | 99.5 |
| 53 | Trimethyl tallow ammonium chloride (Arquad T-50) | 0.36 | 67.16 | 11.27 | 99.7 |
| 54 | Trimethyl coco ammonium chloride (Arquad C-50) | 0.36 | 64.74 | 12.82 | 99.9 |

[8]100% cationic reagent basis

I claim:

1. A process for separating and recovering phosphate values from a low slime siliceous gangue-containing phosphate rock slurry having particles in the size range of about 0.6 to 1.22 mm, comprising (a) conditioning the phosphate rock slurry at a high solids concentration by adding (i) a quaternary ammonium salt having two hydrophobic hydrocarbon groups each having 6 or more carbon atoms and at least one of which contains from about 10–20 carbon atoms;

(ii) a hydrocarbon oil; and (iii) a phosphate depressing agent to form a flotation feed;

(b) subjecting the flotation feed to froth flotation to cause the siliceous gangue impurities having a particle size of about 0.6 to 1.22 mm to be concentrated in the froth; and (c) collecting phosphate rock having a reduced concentration of siliceous mineral impurities from the flotation underflow.

2. The process as defined in claim 1, wherein the salt contains two hydrogenated-tallow groups each containing about 10–20 carbon atoms.

3. The process as defined in claim 2, wherein the sale is a dimethyl di(hydrogenated-tallow) ammonium halide.

4. The process as defined in claim 2, wherein the salt is a diethyl di(hydrogenated-tallow) ammonium halide.

5. The process as defined in claim 2, wherein the salt is a methylbenzyl di(hydrogenated-tallow) ammonium halide.

6. The method as defined in claim 2, wherein each of the hydrogenated-tallow groups contains from about 12–18 carbon atoms.

7. The process as defined in claim 1, wherein the salt is a dimethylbenzyl(hydrogenated-tallow) ammonium chloride.

8. The process as defined in claim 1, wherein at least one hydrophobic hydrocarbon group contains from about 12–18 carbon atoms.

9. The process of claim 1, wherein the phosphate depressing agent is fluosilicic acid.

10. The process as defined in claim 9, wherein the conditioning is carried out at a pH in the range of about 3.0–4.5.

11. The process as defined in claim 10, wherein the pH is in the range of about 3.5–4.0.

* * * * *

UNITED STATES PATENT AND TRADEMARK OFFICE

CERTIFICATE OF CORRECTION

PATENT NO. : 4,737,273

DATED : April 12, 1988

INVENTOR(S) : Robert E. Snow

It is certified that error appears in the above-identified patent and that said Letters Patent are hereby corrected as shown below:

Column 2, line 27, "are" should read -- has

Column 7, line 19, "while" should read -- white --

Column 14, Claim 3, line 1, "sale" should read -- salt --

Signed and Sealed this

Ninth Day of August, 1988

*Attest:*

DONALD J. QUIGG

*Attesting Officer*

*Commissioner of Patents and Trademarks*